US006063005A

United States Patent [19]

Schwartz

[11] Patent Number: 6,063,005

[45] Date of Patent: May 16, 2000

[54] TRACK AND FIELD HURDLE AND BOARD SUPPORTING APPARATUS

[75] Inventor: Jeffrey A. Schwartz, Alpine, N.J.

[73] Assignee: United Canvas & Sling, Inc., Orangeburg, N.Y.

[21] Appl. No.: 08/912,860

[22] Filed: Aug. 19, 1997

[51] Int. Cl.[7] ..... A63K 3/04

[52] U.S. Cl. ..... 482/16; 482/17

[58] Field of Search ..... 482/14–17, 38; 472/85–87

[56] References Cited

U.S. PATENT DOCUMENTS

| | | | |
|---|---|---|---|
| 2,583,786 | 1/1952 | Marzucco | 482/17 |
| 2,718,397 | 9/1955 | Verkuilen | 482/17 |
| 3,024,022 | 3/1962 | Goyette | 482/17 |
| 4,596,388 | 6/1986 | Burden | 482/16 |
| 4,749,187 | 6/1988 | Dellinger et al. | 482/17 |

FOREIGN PATENT DOCUMENTS

| | | | |
|---|---|---|---|
| 339076 | 12/1930 | United Kingdom | 482/17 |

OTHER PUBLICATIONS

UCS Olympic and International Hurdles, M–F 1995 Track and Field Catalog, pp. 32 and 33.

Pacer International Hurdle, 41 in GB (730130), website www.pacerinternational.com, 1998.

*Primary Examiner*—Richard J. Apley
*Assistant Examiner*—Victor Hwang
*Attorney, Agent, or Firm*—Friedman Siegelbaum LLP

[57] ABSTRACT

A track and field board supporting apparatus and hurdle includes a support assembly for positioning on a track or field surface, substantially vertical members emanating from said support assembly and a board holder which facilitates securing a board thereto, wherein the board is aligned properly at/over a desired location on the track.

15 Claims, 10 Drawing Sheets

TRACK AND FIELD HURDLE AND BOARD SUPPORTING APPARATUS

FIELD OF THE INVENTION

The present invention is directed generally to a track and field board supporting apparatus and more particularly to hurdles for use in track and field and to a hurdle board holding apparatus.

BACKGROUND OF THE INVENTION

Hurdles for use in track and field events have been known for centuries. Examples of hurdles are disclosed, for instance, in U.S. Pat. No. 5,334,119 (Eloranto) which is directed to a HURDLE BOOM HOLDER and generally comprises a cupholder for supporting a hurdle boom 10 and having a gliding part 1 which is sleeve like and mounted around a pillar to be moved vertically on the pillar and a support 2 on which the end of the boom is supported. The sleeve like gliding part is "broken" at one point and a locking apparatus is formed by a tightening apparatus which pulls opposite edges of the gliding part toward each other so that the sliding part presses against the pillar.

U.S. Pat. No. 5,352,057 (Zody) is directed to an ADJUSTMENT TOOL FOR TELESCOPING MEMBERS and has a biased detent locking assembly which extends outwardly through aligned apertures in the telescoping members in locked position and which must be depressed inwardly to enable longitudinal adjustment of the members and more particularly to a release tool for quick adjustment of the telescoping legs of track hurdles. The Zody tool is characterized by a pressure plate having an interface with one or more inwardly extending release protuberances and an outer face including a handle for facilitating use and manipulations.

While many hurdles are known and disclosed in many publications and patents (see, e.g., U.S. Pat. No. 3,394,932—Adjustable Counter weighted Hurdle; U.S. Pat. No. 5.205,799—Telescoping Hurdle With Base Adapter; French Patent No. 2,690,628—Multipurpose Gymnastic Device With Adjustable Supports) they do not appear to focus on the need for accurate placement of the hurdle board to be directly above a point where such boards should be for hurdle events. "Accuracy" has typically been achieved by "eyeing" an approximately vertical line from a point on the track to the hurdle board or by using a stick. Of course, the eye could be inaccurate as could a stick if, for instance, it is not held perfectly vertical.

It is therefore an object of the present invention to provide a hurdle in which the hurdle board may easily be placed at a precise location above a certain point or line on a track.

Another object of the invention is to provide a hurdle board holder which is firm and onto which a hurdle board may easily be secured.

SUMMARY OF THE INVENTION

These and other objects of the invention, which shall become hereafter apparent, are achieved by a hurdle for use in track and field events and including a support assembly positioned on a running surface, substantially vertical members emanating from said support assembly and a board holder which facilitates securing a board thereto, wherein the board is alignable precisely at/over a desired location on a track.

BRIEF DESCRIPTION OF THE DRAWINGS

The invention will be better understood by the Detailed Description of the Preferred Embodiment, with reference to the drawings, in which.

DETAILED DESCRIPTION OF THE PREFERRED EMBODIMENT

Figure 1:
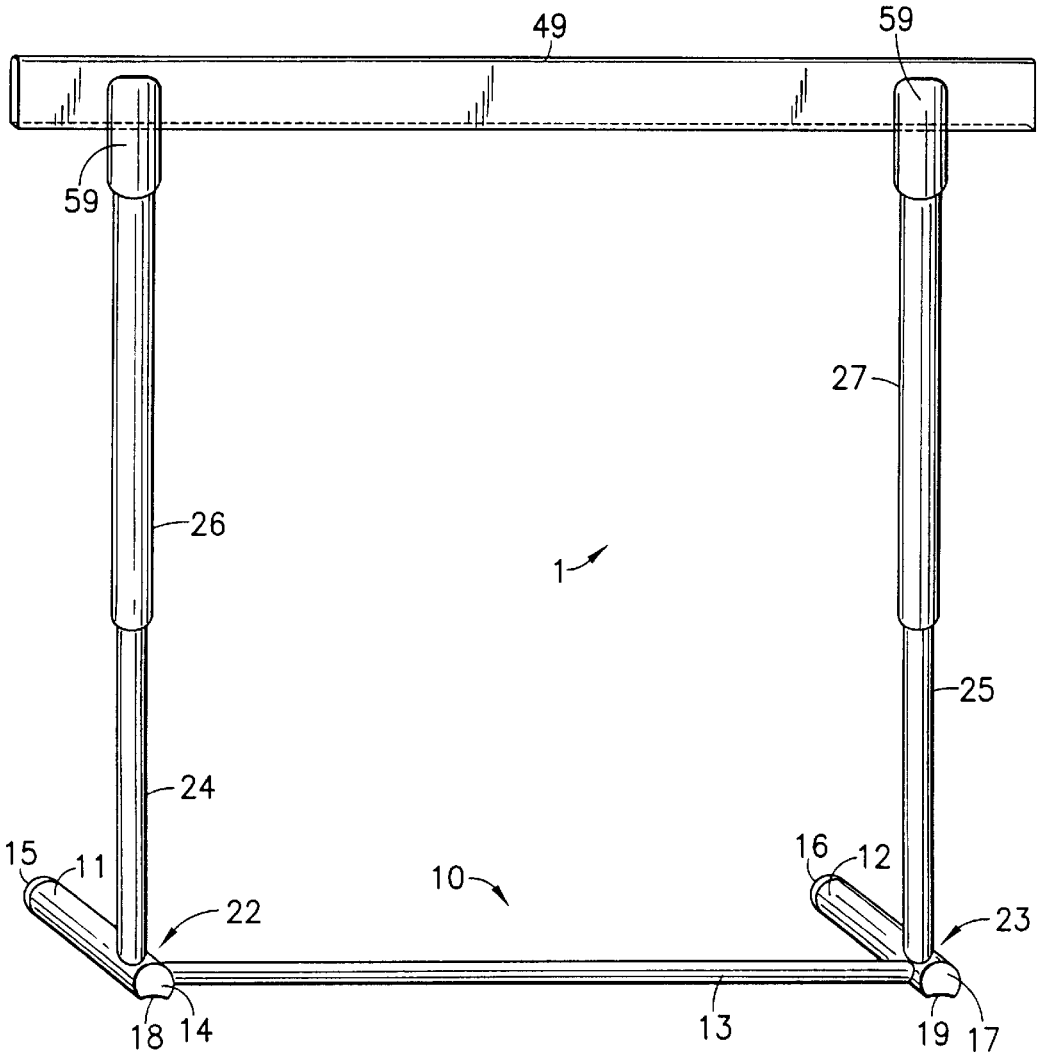
FIG. 1 is a front (finish line) perspective view of the hurdle (by finish line, we are referring to viewing the hurdle from the finish line)
Figure 2:
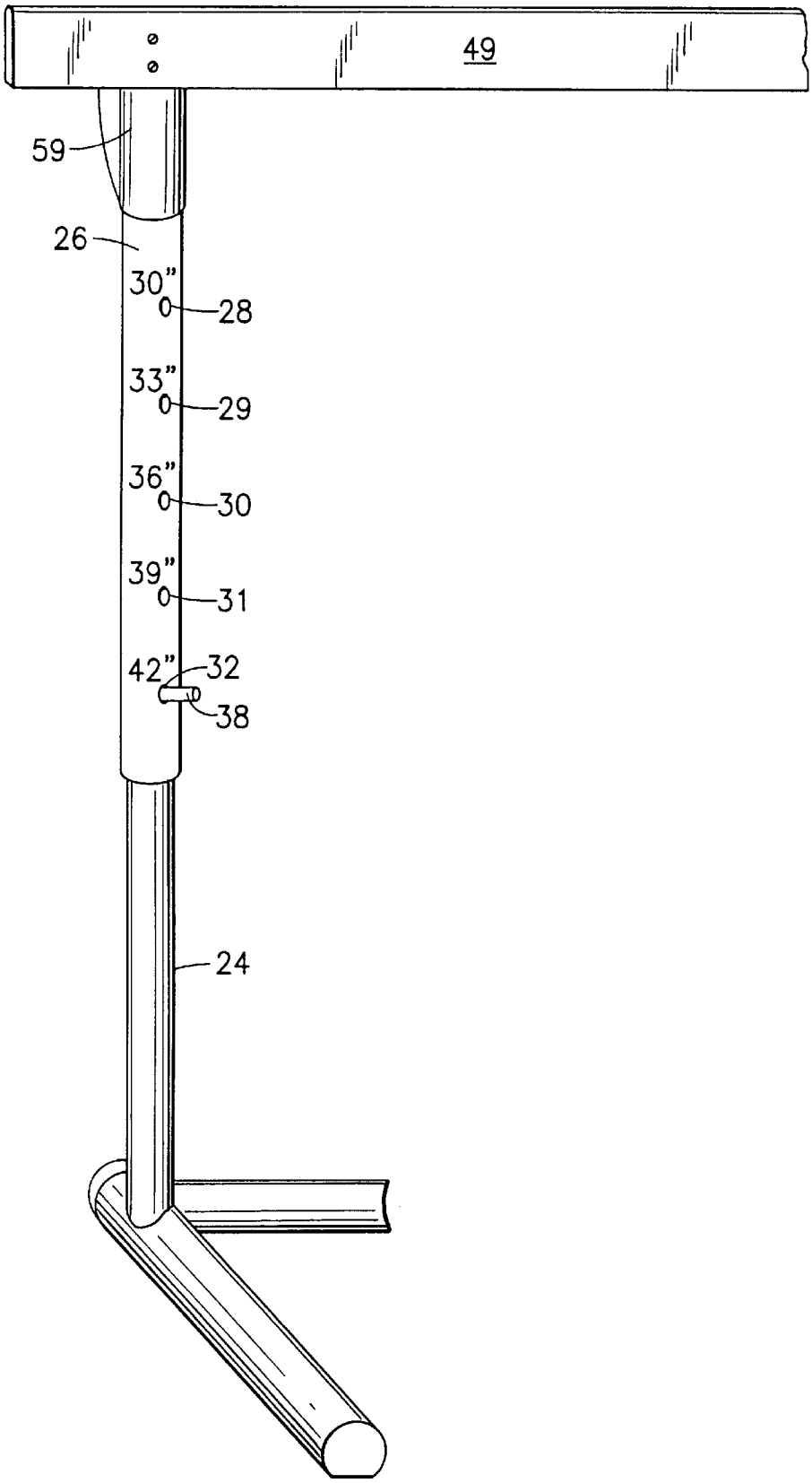
FIG. 2 is a rear (starting line) perspective partial view of the hurdle.
Figure 3:
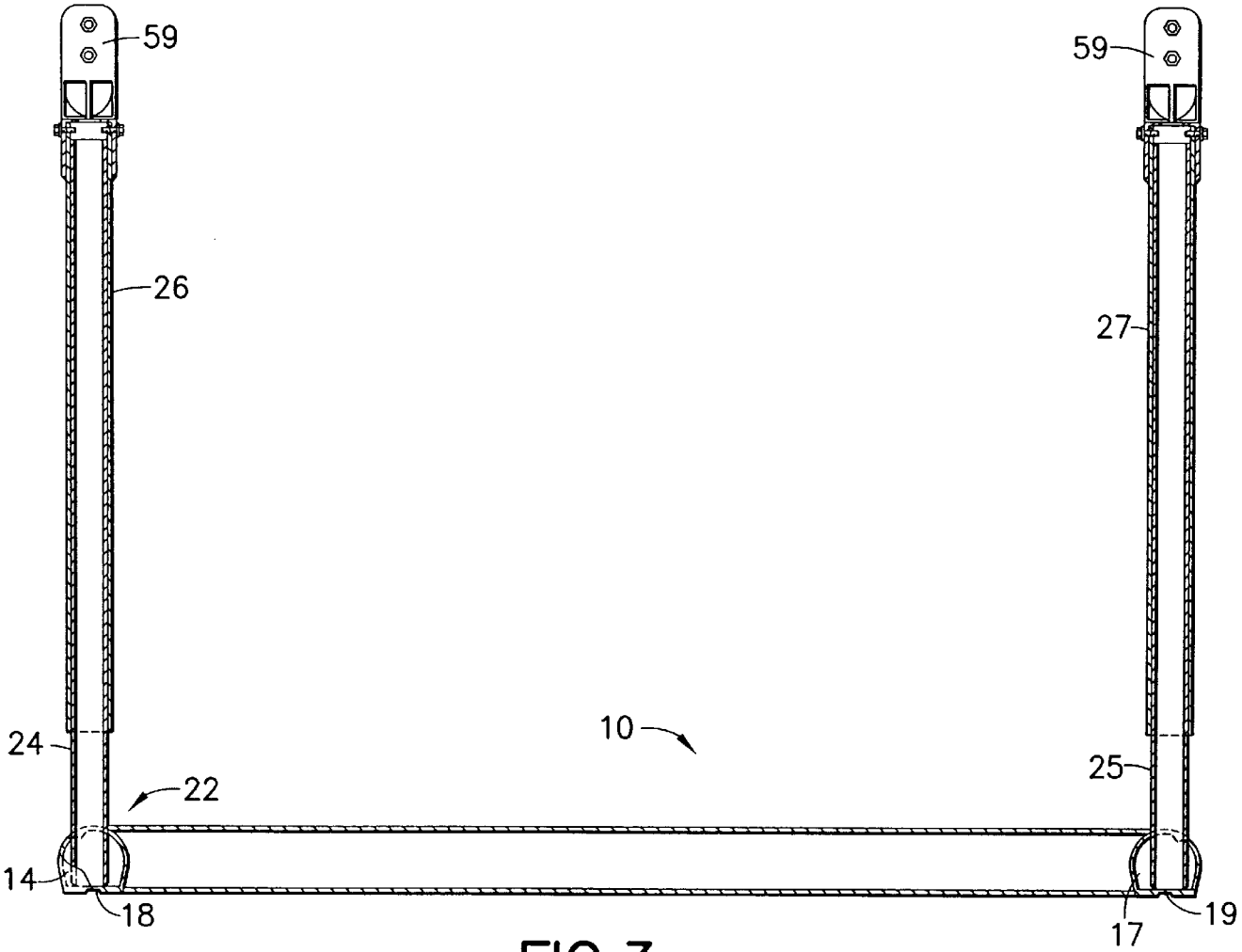
FIG. 3 is a starting line cross-sectional view of the hurdle.
Figure 4:
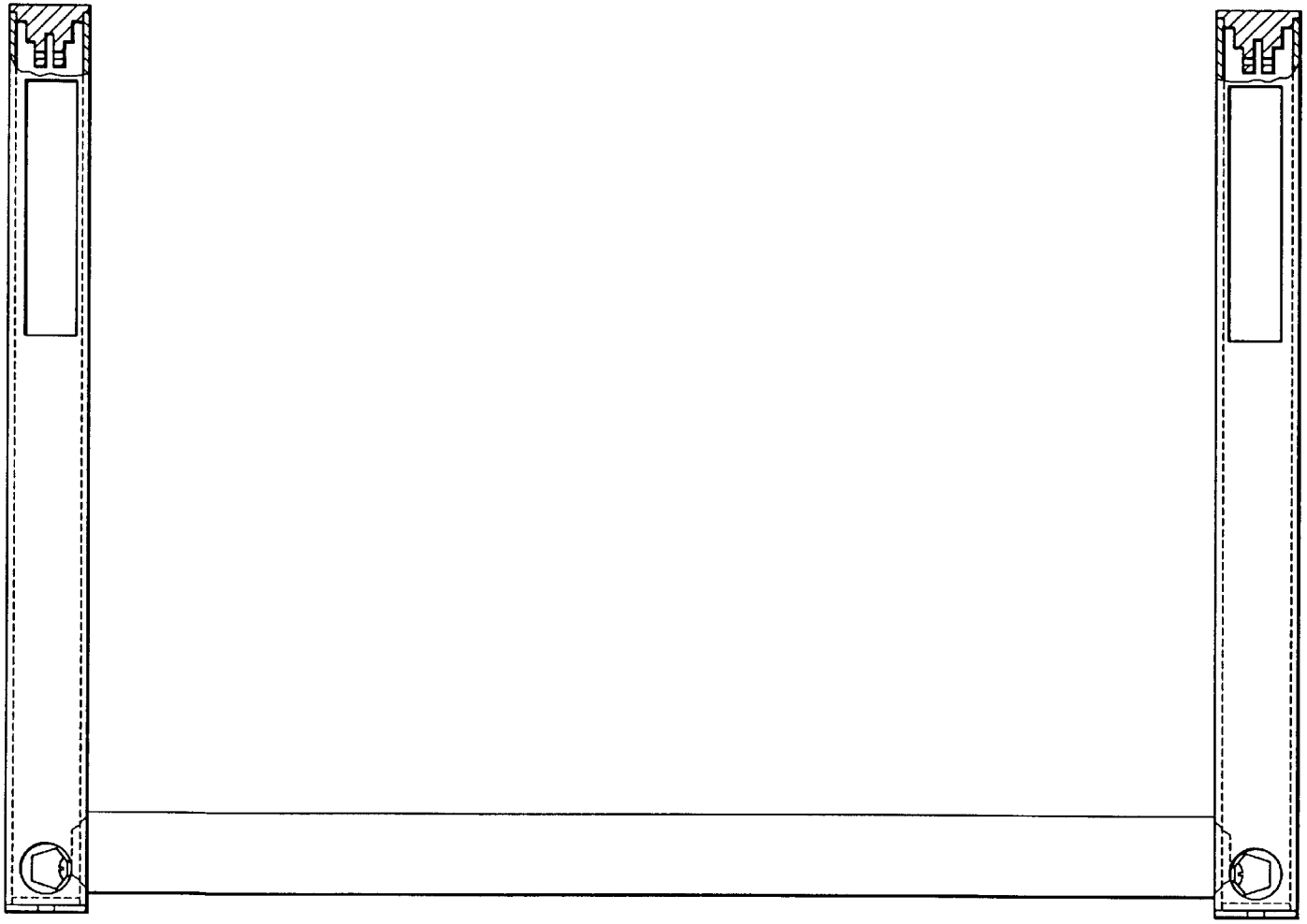
FIG. 4 is a plan view of the hurdle.
Figure 5:
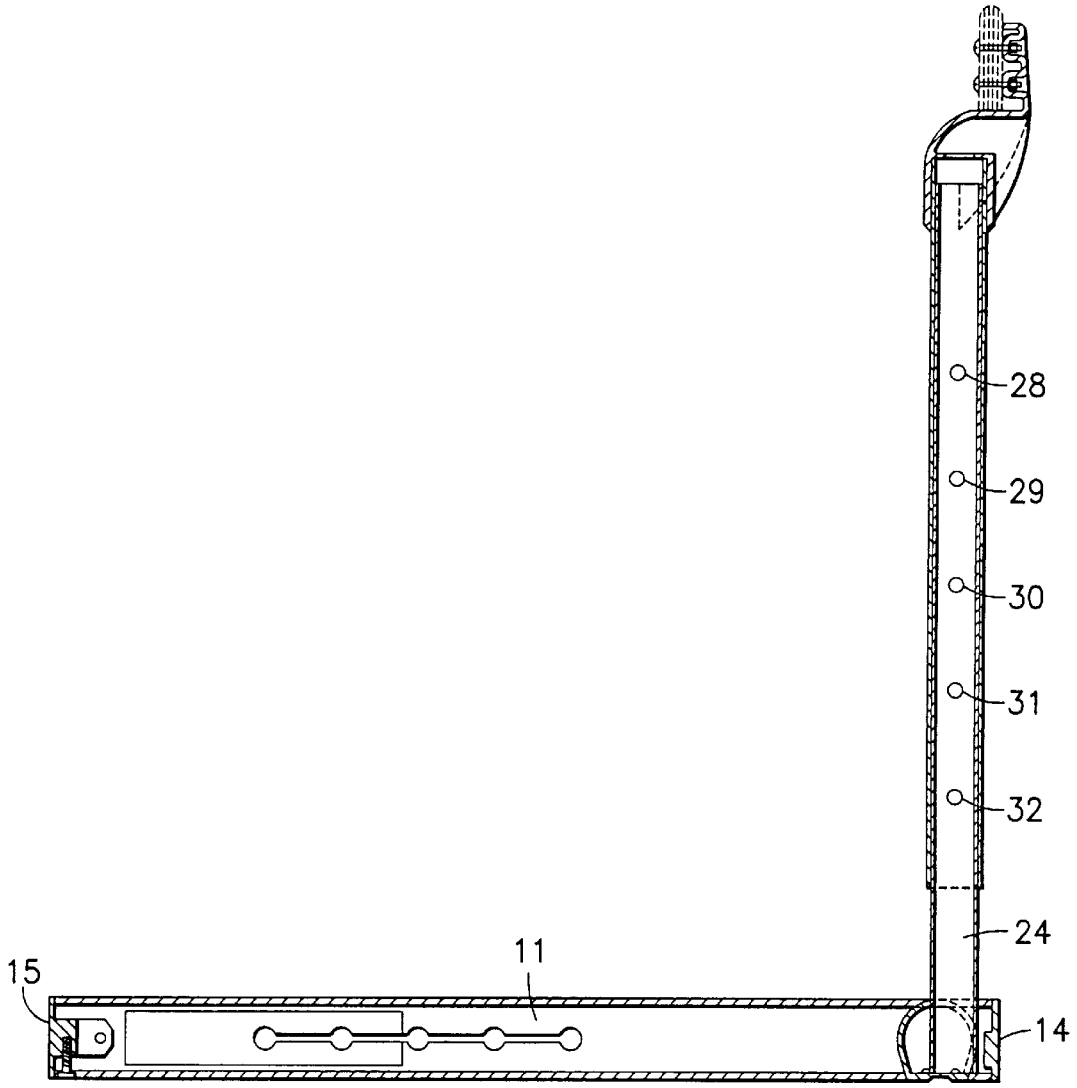
FIG. 5 is a right-side, cross-sectional view of the hurdle.
Figure 6:
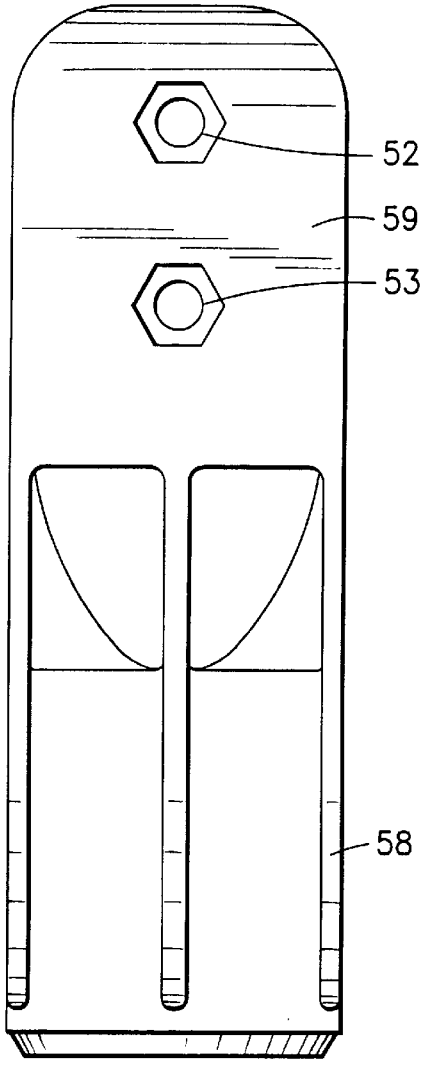
FIG. 6 is a finish line view of the board holder.
Figure 7:
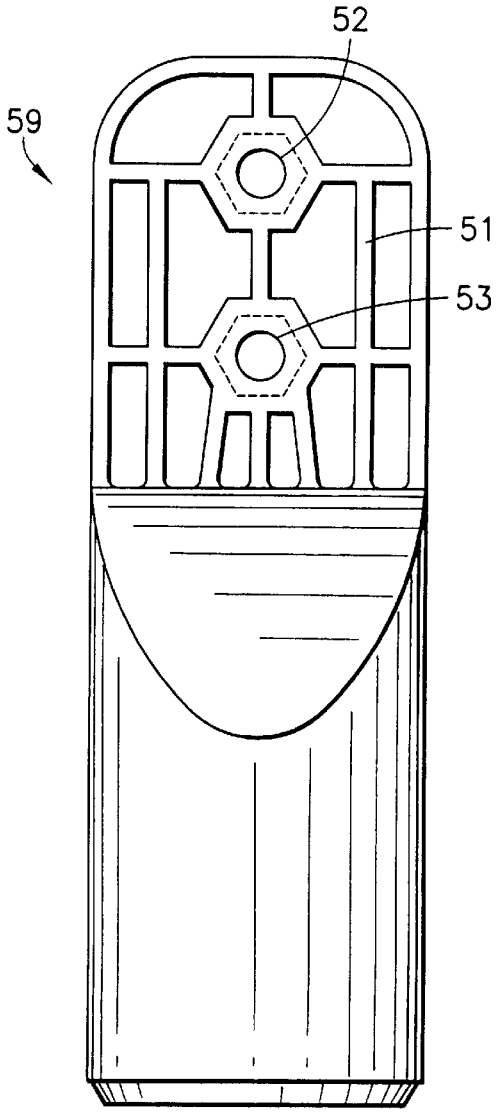
FIG. 7 is a starting line view of the board holder.

Referring now to the drawings, wherein like numerals represent like elements throughout the several views, FIGS. 1–5 show hurdle 1, generally comprising U-shaped base 10 having two parallel 11, 12 and one perpendicular 13 hollow pole segments preferably having a 2¼" by 2¼" by 3/16" dimension and made of a custom-designed aluminum profile for strength and stability. Each parallel pole segment 11, 12 is connected at its respective finish line end by perpendicular pole 13.

Die-cast aluminum end caps 14–17 are placed on the front and rear openings on the parallel poles to form a fit without sharp edges. Each end cap 14–17 has an exclusive slotted profile 18, 19 which allows for quick stacking and locking of up to 12 hurdles.

Projecting upwardly from the respective corners 22, 23 are two substantially vertical upright columns 24, 25, each of which are circumscribed preferably by a 1⅝" aluminum five height telescopic tube 26, 27 which can, for example, be available in many designs or colors such as school colors. Each tube 26, 27 has a set of five aligned and evenly spaced apertures 28–32 (See FIG. 2) such that a slide adjustment button 38 on each vertical column 24, 25 may be pushed inwardly in order for each tube 26, 27 to slide up or down to have the hurdle reach a desired height. Preferably. the top hole 28 would correspond to a 30" height of the hurdle board 49 off the ground, whereas the bottom hole 32 would correspond to the hurdle board being 42" off the ground.

Figure 8:
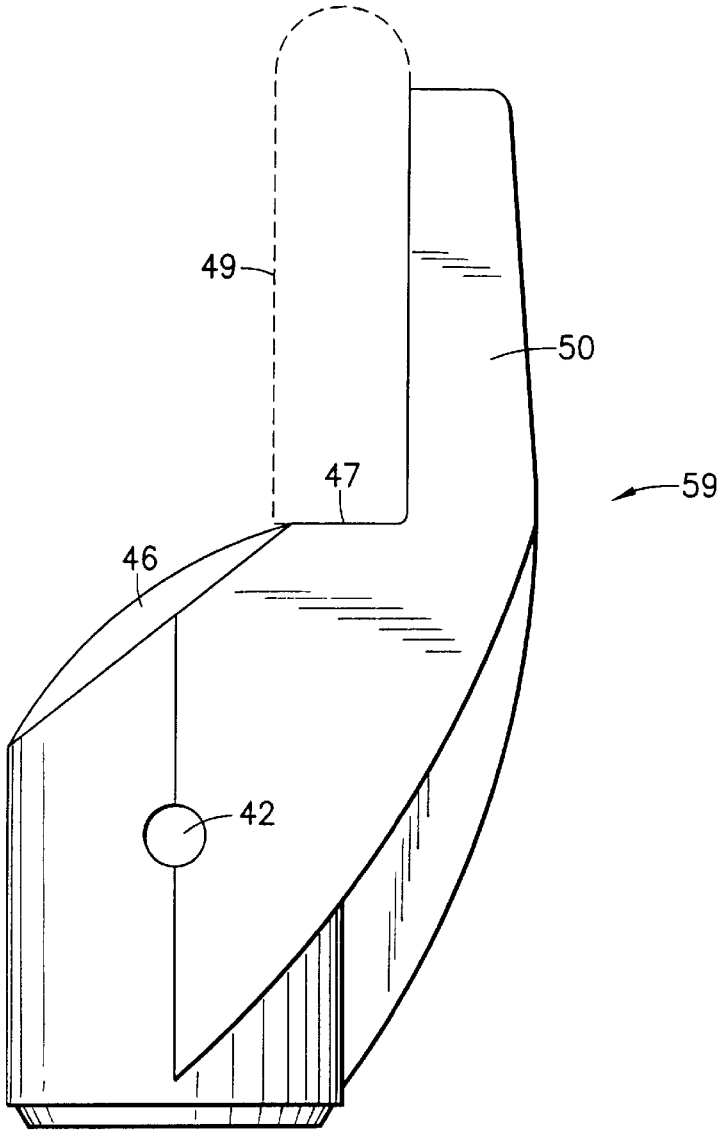
FIG. 8 is a right-side view of the board holder.
Figure 8A:
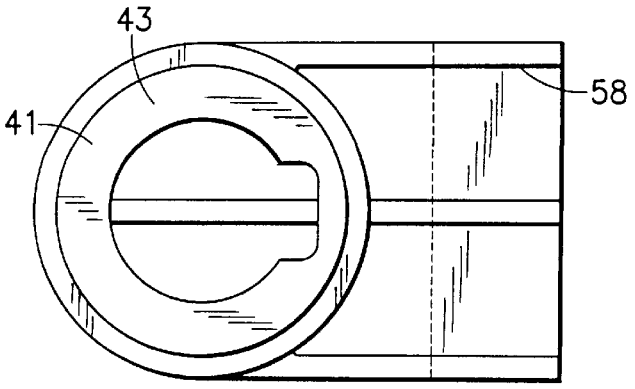
FIG. 8A is a bottom view of the board holder.
Figure 10:
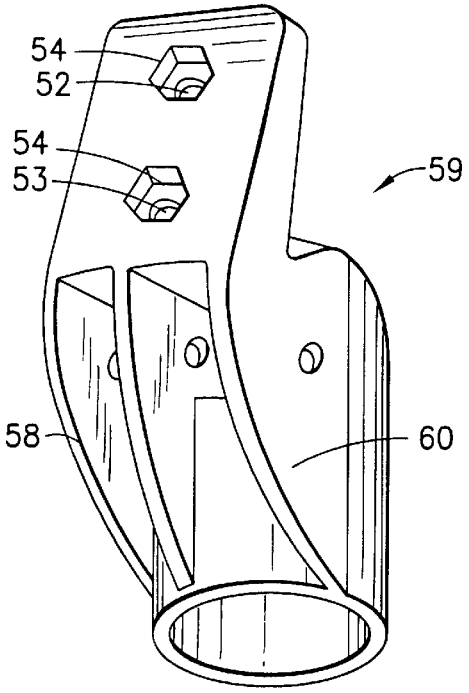
FIGS. 10 and 11 and 12 are various three dimensional perspective views of the board holder.
Figure 11:
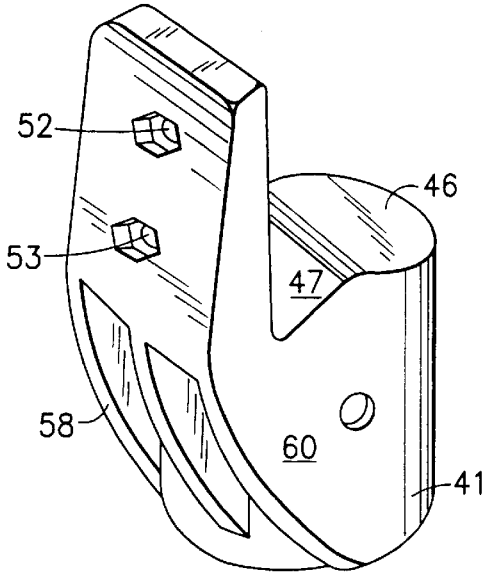
Figure 12:
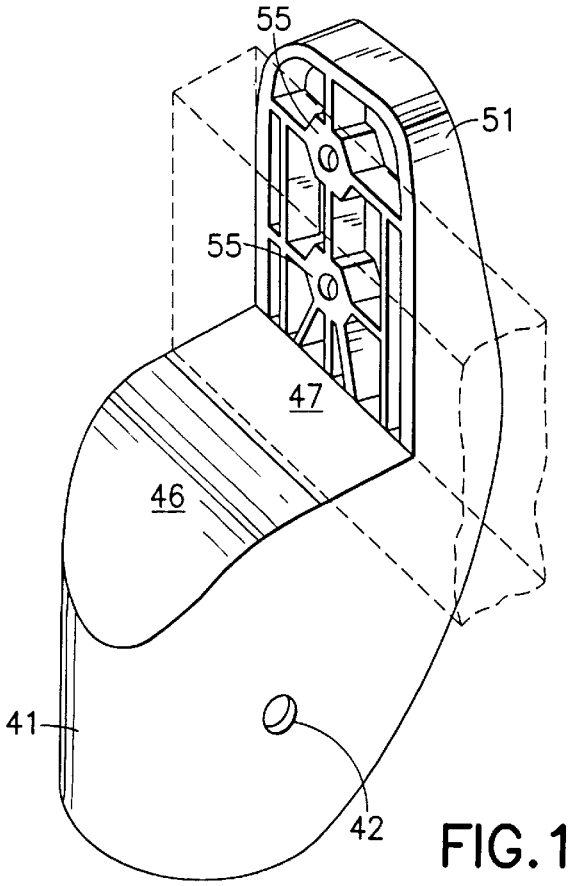

At the end of each tube 26, 27 is an exclusive UCS design Zytel board holder 59 (see FIGS. 10–12) which allows the hurdle board to be located at a precise location as explained subsequently herein. All one needs to do is place the hurdle 1 on a desired mark or point on the track and the board lines up correctly. The hurdle board 49 is made from a known element such as a 3¼" select grade wood or polycarbonate tri-ribbed composite board. The board holder 59 generally comprises a substantially vertical tube stop 41 with holes 42. The tube stop 41 segment is preferably cylindrical and has a barrier (see FIG. 8) which prevents the tube 26, 27 from traveling beyond it. Extending across the top of the board holder 59 is slope 46 which meets a horizontal planar surface 47 on which a lower edge of hurdle board 49 is positioned. The finish line face of the hurdle board abuts hurdle board backstop 50. Slopes 46 and 47 can vary as shown in FIGS. 10 and 11.

Backstop 50 has a number of reinforcing ribs 51 and at least a pair of apertures 52, 53 drilled into the backstop 50 to facilitate the attachment of the hurdle board 49 to the board holder 59. The apertures 52, 53 in the manual board holder are circumscribed by two hexagonal inner 54 (concave) and outer 55 (convex) structures, as shown, for example, in FIGS. 11 and 12. The inner 54 and outer 55 hexagonal-shaped structures facilitate the insertion of a bolt into the inner 54 hexagonal concave cavity which will hold bolt firm so that the corresponding nut may be securely fastened at the other end. Also angled from the vertical tube stop 41, at the rear thereof, are three extending ribs 56,57 and 58 which help absorb downward pressure on the hurdle board, when, for instance, an athlete's leg comes down and hits the hurdle.

Figure 9:
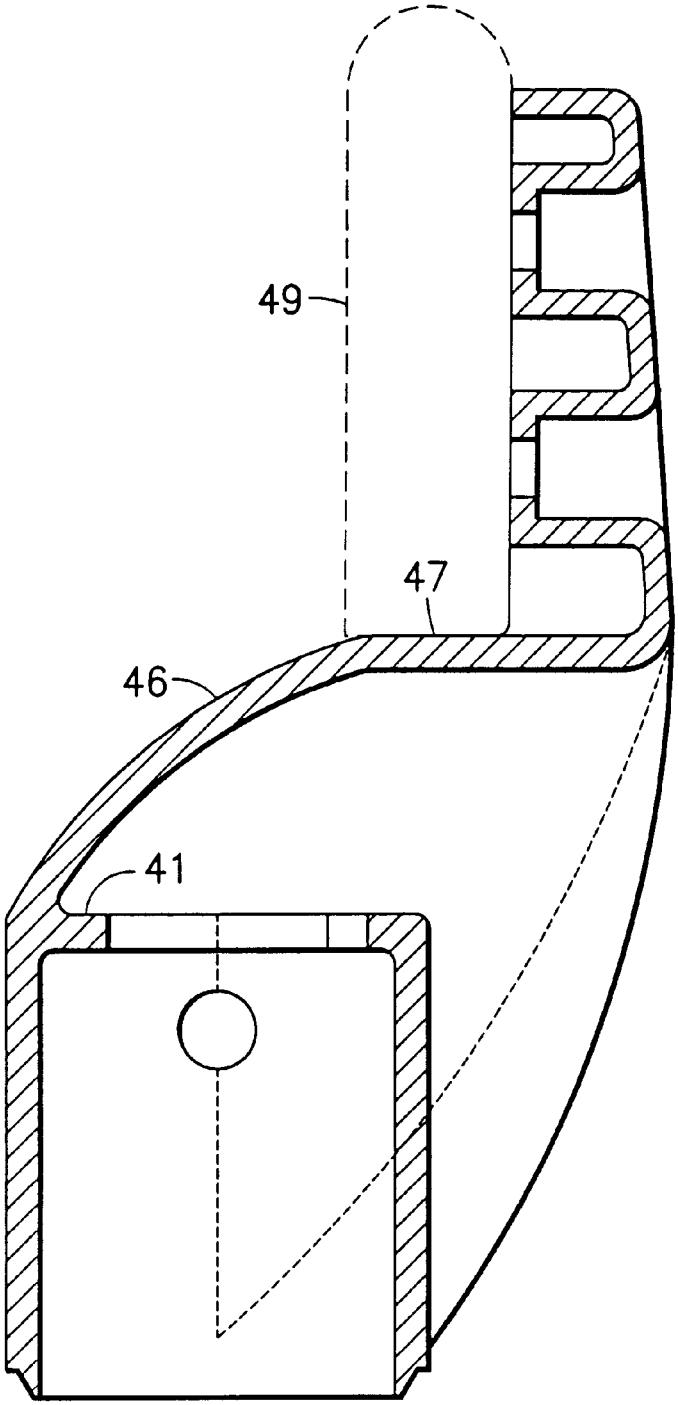
FIG. 9 is a cross-sectional right-side view of the board holder.
Figure 13:
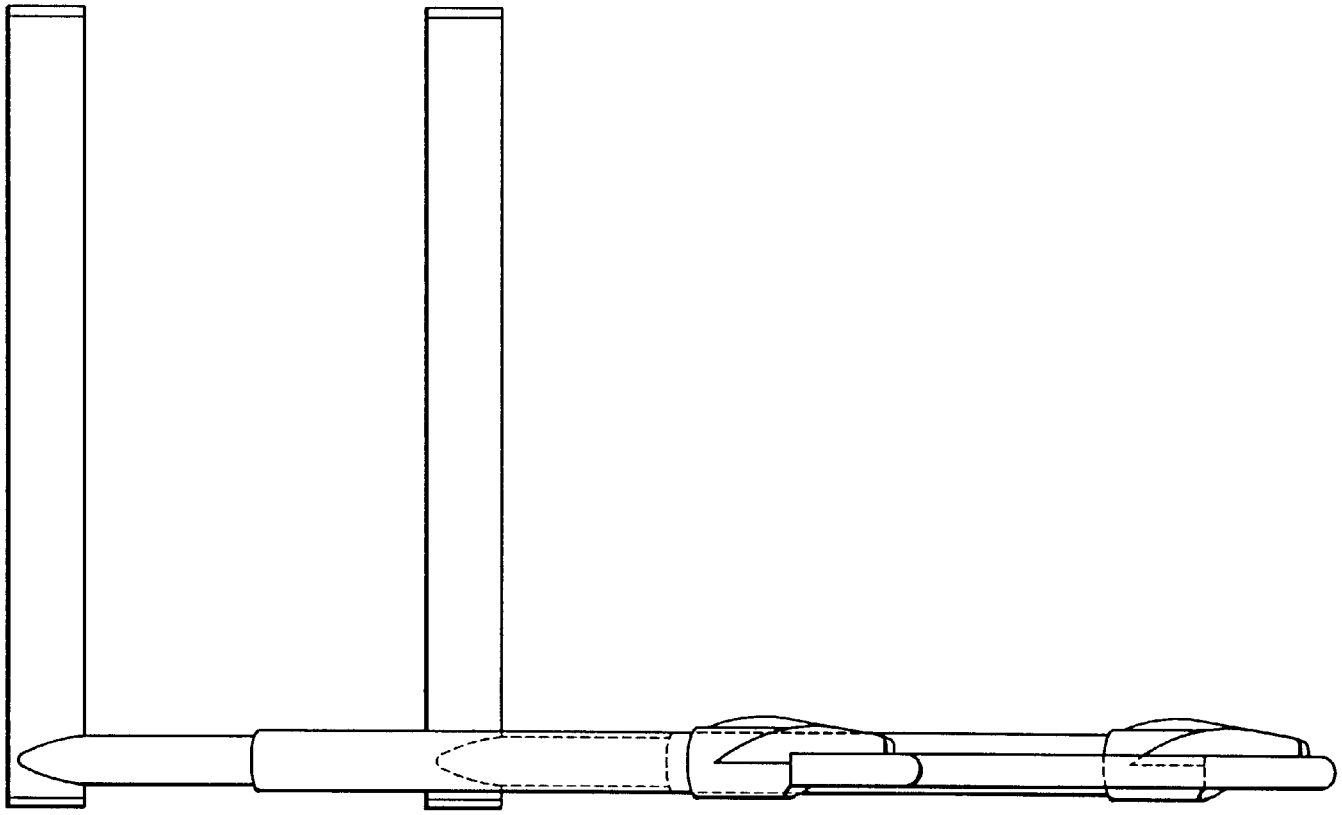
FIG. 13 is a side perspective view of the hurdle shown on a track.

FIG. 13 shows how the hurdle board 49 is lined up precisely at/over a desired location on the track. As best demonstrated by FIGS. 13 and cross-sectional FIG. 9, the middle of the hurdle board is lined up with the middle of a desired line because horizontal surface 47 on each board holder 59 is positioned just beyond the end of the vertical columns 24, 25 and tubes 26, 27.

It should additionally be pointed out that while the preferred use of the invention is as a hurdle, it may have other uses such as for high jump, pole vault, steeplechase, equestrian events, etc.

While the preferred embodiment of the invention has been depicted in detail, modifications and adaptations maybe made thereto, without departing from the spirit and scope of the invention as delineated in the following claims:

What is claimed is:

1. A hurdle apparatus for use on a track or field surface, said apparatus comprising:

a support assembly;

substantially vertical members emanating from said support assembly;

substantially vertical segments secured to said vertical members;

incremental locking means for locking said vertical segments and members at a desired position with respect to each other;

a board; and a board holder detachably secured to said substantially vertical members, said board holder having a substantially horizontal surface area and a backstop for supporting the board, said area laterally offset from said substantially vertical members to facilitate location of said board over a desired location on the track or field.

2. The apparatus of claim 1, wherein said support assembly further comprises a u-shaped base having two substantially parallel poles.

3. The apparatus of claim 2, wherein said support assembly further comprises a perpendicular pole.

4. The apparatus of claim 3, wherein said poles are made of aluminum.

5. The apparatus of claim 4, wherein said poles are dimensioned approximately 2¼"×2¼"×3/16".

6. The apparatus of claim 2, further comprising openings at ends of said parallel poles.

7. The apparatus of claim 6, further comprising end caps to substantially fill said openings.

8. The apparatus of claim 7, wherein said end caps have a slotted configuration to facilitate stacking of a plurality of hurdles.

9. The apparatus of claim 8, wherein said board is 3¼" in width.

10. The apparatus of claim 9, wherein said board is made of select grade wood.

11. The apparatus of claim 9, wherein said board is made of a polycarbonate tri-ribbed composite.

12. The apparatus of claim 1, wherein said locking means comprises apertures and push button element.

13. The apparatus of claim 12, wherein said apertures are substantially uniformly spaced to correspond to a desired height of the board.

14. The apparatus of claim 13, wherein said columns have color and design.

15. The apparatus of claim 1, wherein said board holder includes a tube stop.

* * * * *